US005186753A

United States Patent [19]

Nakazawa et al.

[11] Patent Number: 5,186,753

[45] Date of Patent: Feb. 16, 1993

[54] FOUNTAIN COATER

[75] Inventors: Takeo Nakazawa; Hirofumi Morita; Takeshi Hitomi; Katsumi Ishizuka, all of Tokyo, Japan

[73] Assignee: Ishikawajima-Harima Jukogyo Kabushiki Kaisha, Tokyo, Japan

[21] Appl. No.: 711,065

[22] Filed: Jun. 6, 1991

[30] Foreign Application Priority Data

Jul. 10, 1990 [JP] Japan ..... 2-73283[U]
Jul. 10, 1990 [JP] Japan ..... 2-181827
Aug. 1, 1990 [JP] Japan ..... 2-81761[U]

[51] Int. Cl.[5] ..... B05C 5/02

[52] U.S. Cl. ..... 118/410; 118/413; 118/419

[58] Field of Search ..... 118/410, 413, 419; 427/356, 357, 358

[56] References Cited

U.S. PATENT DOCUMENTS 2,981,224 4/1961 Phelps ..... 118/63
4,387,663 6/1983 Alheid ..... 118/413
4,398,494 8/1983 Alheid ..... 118/410

FOREIGN PATENT DOCUMENTS 3724374 2/1988 Fed. Rep. of Germany .
2106015 4/1983 United Kingdom .
2194744 3/1988 United Kingdom .

OTHER PUBLICATIONS

Patent Abstract of Japan, vol. 14, No. 294 Jun. 26, 1990 JP-A-02 095 473 (Mitsubishi Heavy Ind. Ltd) Apr. 6, 1990.

*Primary Examiner*—Michael G. Wityshyn
*Attorney, Agent, or Firm*—Oblon, Spivak, McClelland, Maier & Neustadt

[57] ABSTRACT

A fountain for applying a coating color on a surface of a web which is engaged with a backing roll for movement of the web is supported by an application adjusting mechanism such that the fountain can be angularly adjusted around a tip of the fountain, so that the fountain angle can be adjusted without changing a gap between the tip of the fountain and the surface of the web. The application adjusting mechanism may be installed on a dwell time adjusting mechanism which is pivoted around an axis of the backing roll so that the dwell time can be adjusted without changing the gap between the tip of the fountain and the surface of the web as well as the fountain angle.

5 Claims, 10 Drawing Sheets

FOUNTAIN COATER

BACKGROUND OF THE INVENTION

The present invention relates to a fountain coater for applying a coating color on a web.

A fountain coater of this kind has been designed for example as shown in FIG. 1 which has a main body frame 1 and a backing roll 2 rotatably supported by the frame 1 about an axis 0. The roll 2 has an outer periphery on which elastic substance (not shown) such as rubber is wound. A web 3 is engaged with the roll 2 for movement of the web 3. A fountain 5 is mounted on a stationary frame 10 fixed to the frame 1 so as to be swung around an axis F. The fountain 5 has a slit 9 which extends in parallel with the axis 0 and through which a coating color 4 is applied to the web 3. The frame 1 pivotably supports a drive such as a cylinder 11 which has a rod 12 connected at its tip with a bracket 50 which in turn is integral with the fountain 5. A metering element 7 such as blade or rod is installed downstream of the fountain 5 in the direction of movement of the web 3 so as to remove excessive coating color 4 and form a uniform coating color layer 6 on the web 3. In the figure, reference numeral 8 represents a holder for the element 7; and 27, a header for supplying the coating color 4 to the fountain 5.

In order to apply the coating color 4 to the web 3, the drive 11 is energized to swing the fountain 5 around the axis F to adjust an angle for application of the coating color 4 defined by the web 3 and the color 4 at a point of their encounter, the angle (hereinafter referred to as fountain angle) being determined by conditions such as material of the web 3, kind of the coating color 4 and feed speed V of the web 3, whereby all amount of the coating color 4 is applied uniformly on the web 3.

Such conventional fountain coater, which adjusts the fountain angle through swinging of the fountain 5 around the axis F, is disadvantageous in that the gap between a tip of the fountain 5 and the surface of the web 3 cannot be maintained constant when the fountain angle is changed.

To overcome such disadvantage, the present invention has its object to offer a fountain coater capable of adjusting the fountain angle without changing the gap between the tip of the fountain and the surface of the web.

BRIEF SUMMARY OF THE INVENTION

The present invention is directed to a fountain coater which includes a fountain for applying a coating color on a surface of a web engaged with a backing roll for movement thereof and a metering element at an outer periphery of the backing roll and downstream of the fountain for removing excessive coating color applied to form a uniform coating color layer on the web and which is characterized by an application adjusting mechanism through which the fountain is pivotably supported at its tip so as to be angularly displaceable around the tip. The application adjusting mechanism may be installed on a dwell time adjusting mechanism which is pivotable around an axis of the backing roll.

Because of the fountain being angularly displaceable around the tip of the fountain, the fountain angle can be adjusted without changing the gap between the tip of the fountain and the surface of the web.

When the application adjusting mechanism is installed on the dwell time adjusting mechanism, the gap between the tip of the fountain and the surface of the web as well as the fountain angle can be maintained without change even when dwell time is changed.

Preferred embodiments of the present invention will be described in conjunction with the drawings.

DETAILED DESCRIPTION OF THE PREFERRED EMBODIMENTS

Figure 1:
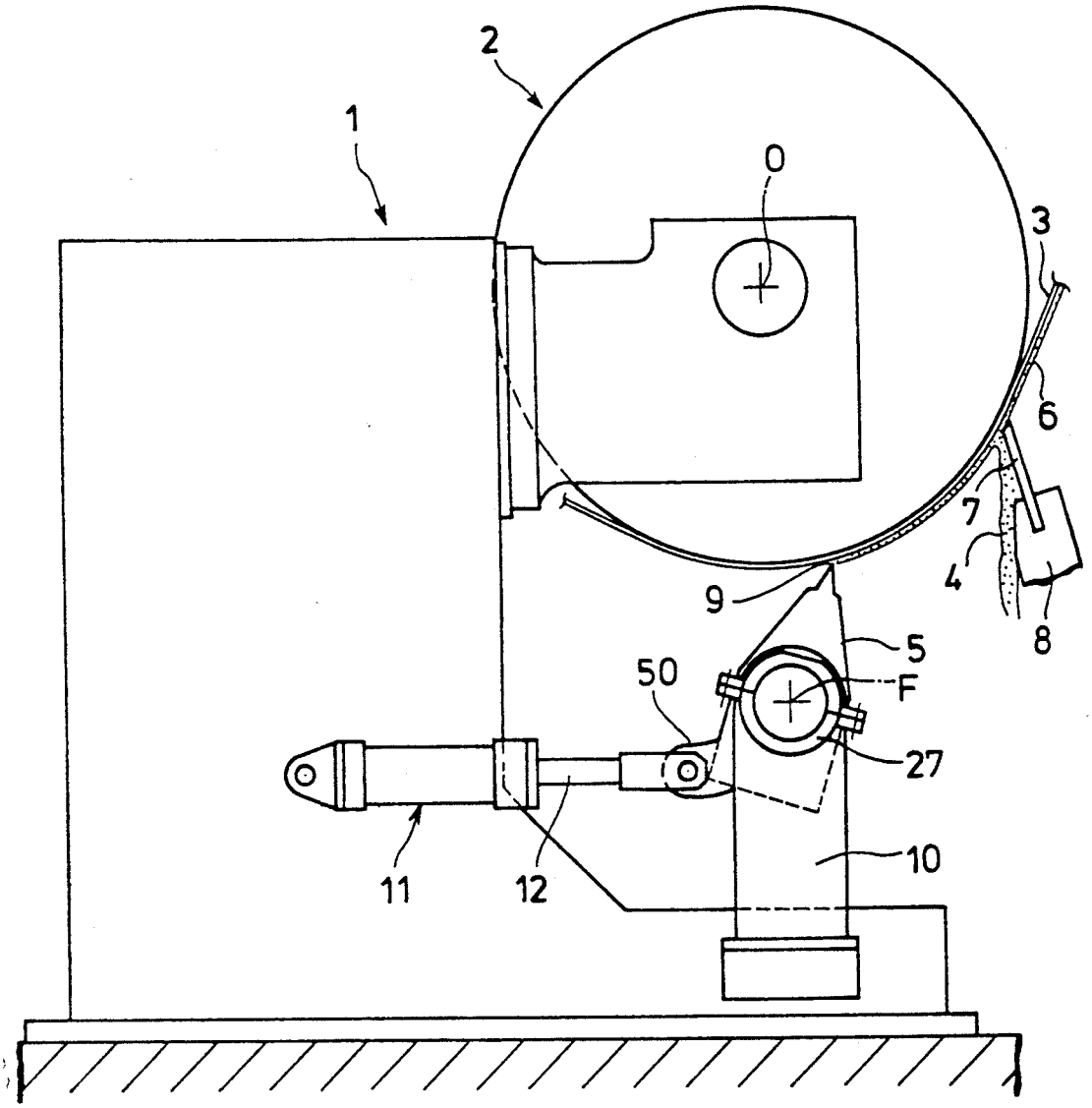
Fig. 1 PRIOR ART
FIG. 1 is a side view of a conventional fountain coater.

FIGS. 2, 3, 4(A) and 4(B) show a first embodiment of the present invention in which the same reference numerals as in FIG. 1 refer to the same components.

A main body frame 1 pivotably supports a gap adjusting bracket 16 through a pin 51 extending axially of the backing roll 2. The frame 1 pivotally supports a drive such as a cylinder 18 which has a rod 19 pivoted on a drive arm 16*a* of the bracket 16. The frame 1 has a support stand 52 which extends horizontally from the frame 1 and on which a positioning jack 53 is mounted. The jack 53 has a rod 54 abutting on a base arm 16*c* of the bracket 16. Thus, a gap adjusting mechanism 29 is provided so that interlocked stretching and contracting movement of the drive 18 and jack 53 can swing the gap adjusting bracket 16 around an axis G of the pin 51.

The bracket 16 has an operating arm 16*b* at the tip of which a fountain angle adjusting bracket 20 is pivoted through a pin 21 extending in parallel with the pin 51. The bracket 16 pivotally supports through a pin 22 a drive 26 such as bearlocked cylinder having high positioning accuracy which in turn is pivoted at its tip on a drive arm 20*a* of the bracket 20 so that stretching and contracting movement of the drive 26 swings the bracket 20 around an axis B of the pin 21. A fountain 5 is mounted on the bracket 20 such that its tip is approximately on the axis B. Thus, a fountain angle adjusting mechanism 30 is provided. The fountain angle adjusting mechanism 30 and the gap adjusting mechanism 29 constitute an application adjusting mechanism 31 on the frame 1.

Next, description is given on the operation of the first embodiment.

When the rod 19 of the drive 18 is stretched or contracted and the jack 53 is contracted or stretched, the gap adjusting bracket 16 and the fountain angle adjusting bracket 20 are integrally swung around the axis G of the pin 51 and the distance between the axes 0 and B are changed. That is, the gap t between the tip of the fountain 5 and the surface of the web 3 (see FIG. 4(A) or 4(B)) can be set to a desired value through actuation of the drive 18 and the jack 53.

Figure 2:
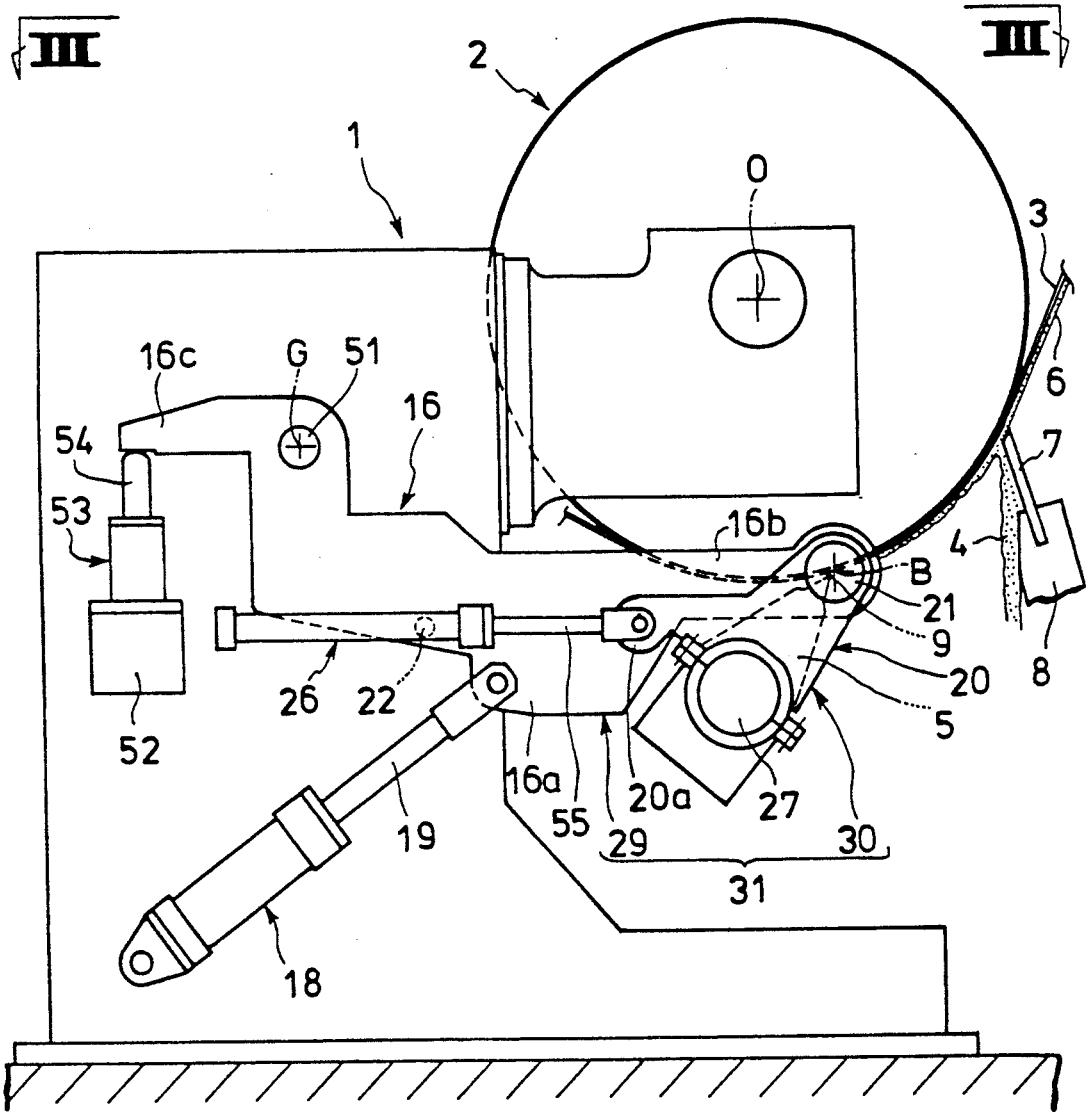
FIG. 2 is a side view of a first embodiment of the present invention.
Figure 3:
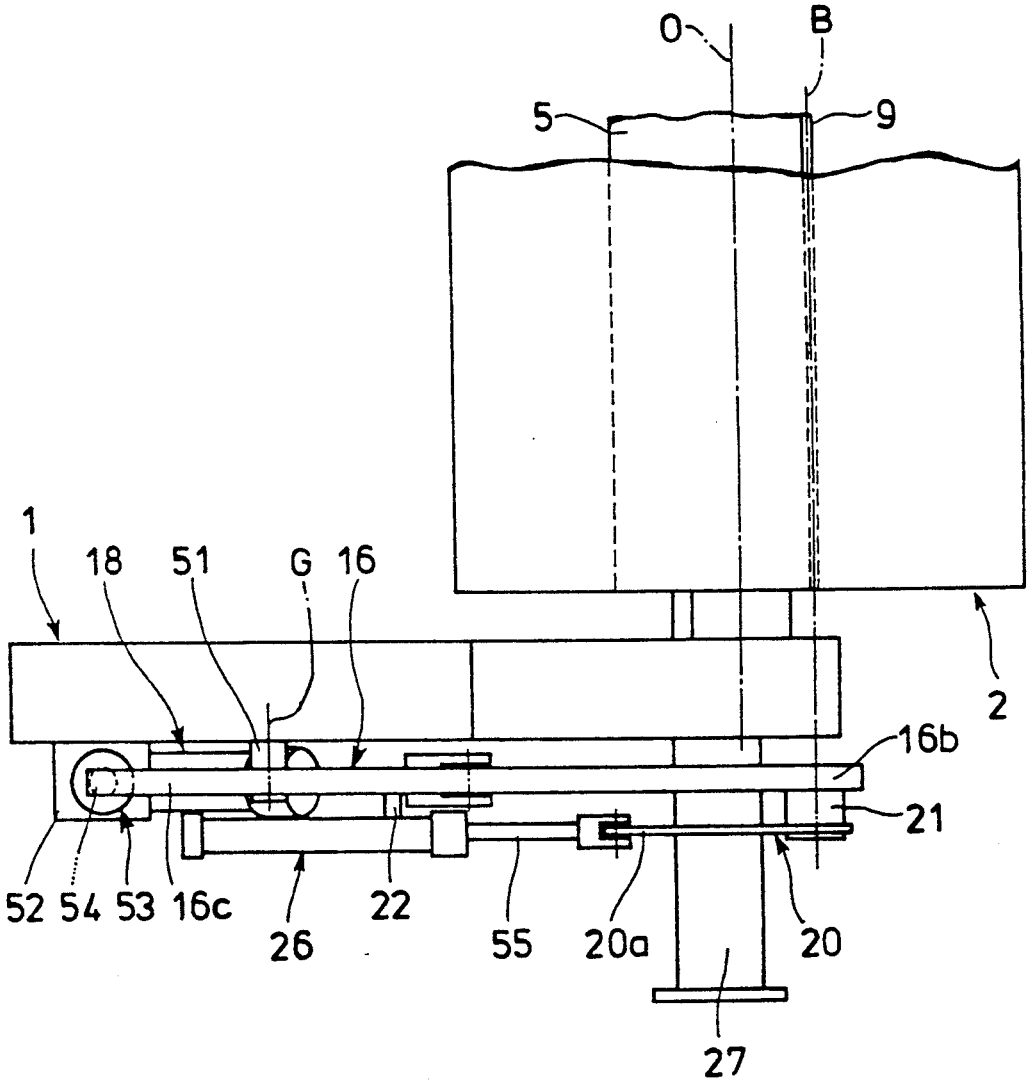
FIG. 3 is a view looking in the direction of the arrows III—III in FIG. 2.

When the drive 26 is stretched or contracted under the condition as shown in FIG. 2, the fountain angle adjusting bracket 20 is swung around the axis B of the pin 21 relative to the gap adjusting bracket 16. As a result, the fountain angle $\theta$ defined by the web 3 and the coating color 4 at a point P of their encounter (see FIG. 4(A) or 4(B)) can be set without changing the gap t which had been set to the desired va;ue as described above.

In this way, under the condition that the gap t between the tip of the fountain 5 and the surface of the web 3 is maintained to the desired value, the fountain angle can be adjusted which is to be selected from conditions such as material of the web 3, type of the coating color 4, feed speed V of the web 3, etc. Thus, the coating color 4 can be effectively applied to the web 3 without causing disorder or splashing of the coating color 4.

In the above embodiment, when a bearlocked cylinder having high positioning accuracy is used as drive 18, the positioning jack 53 may be omitted.

Figure 5A:
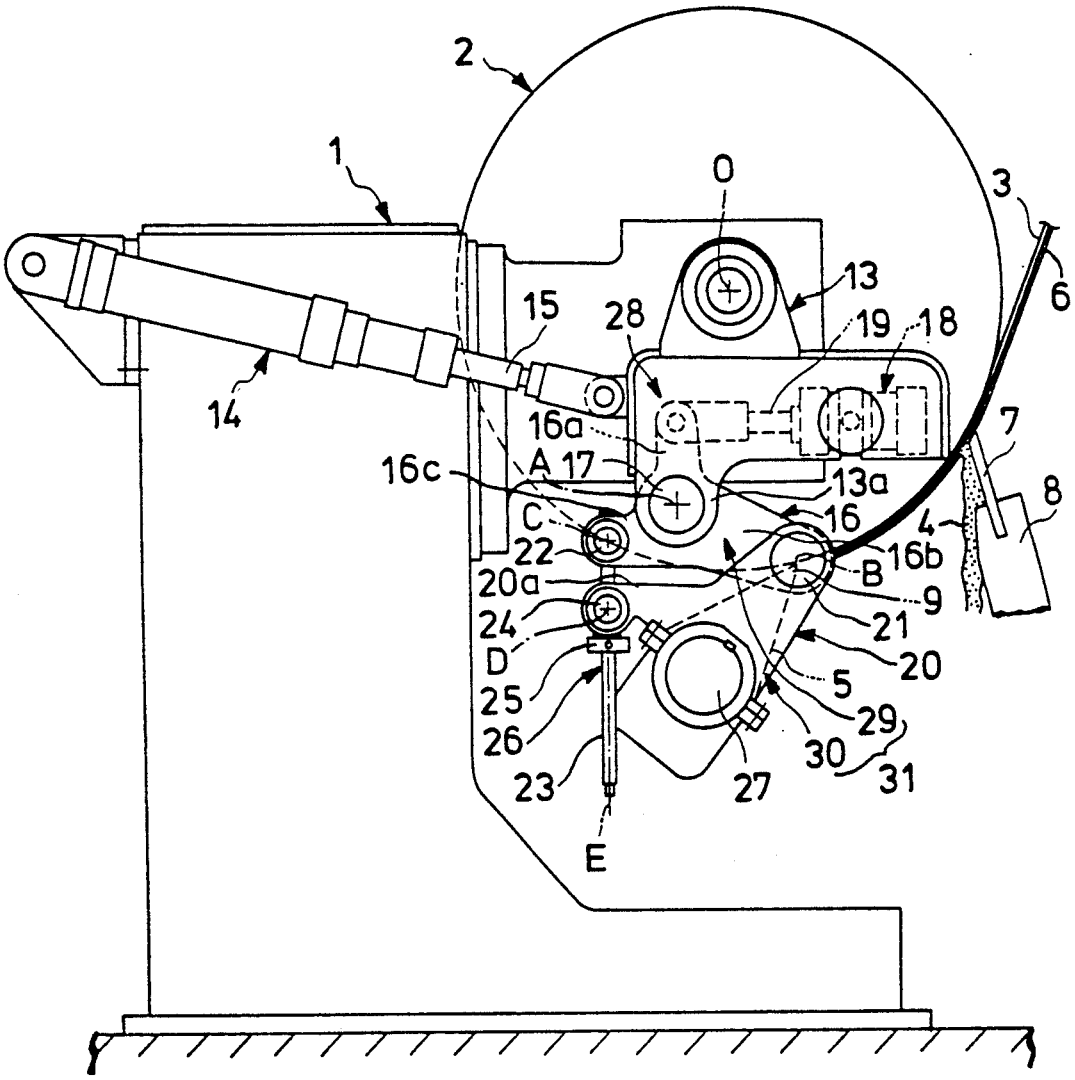
FIGS. 5(A) and 5(B) are side views of a second embodiment of the present invention.
Figure 5B:
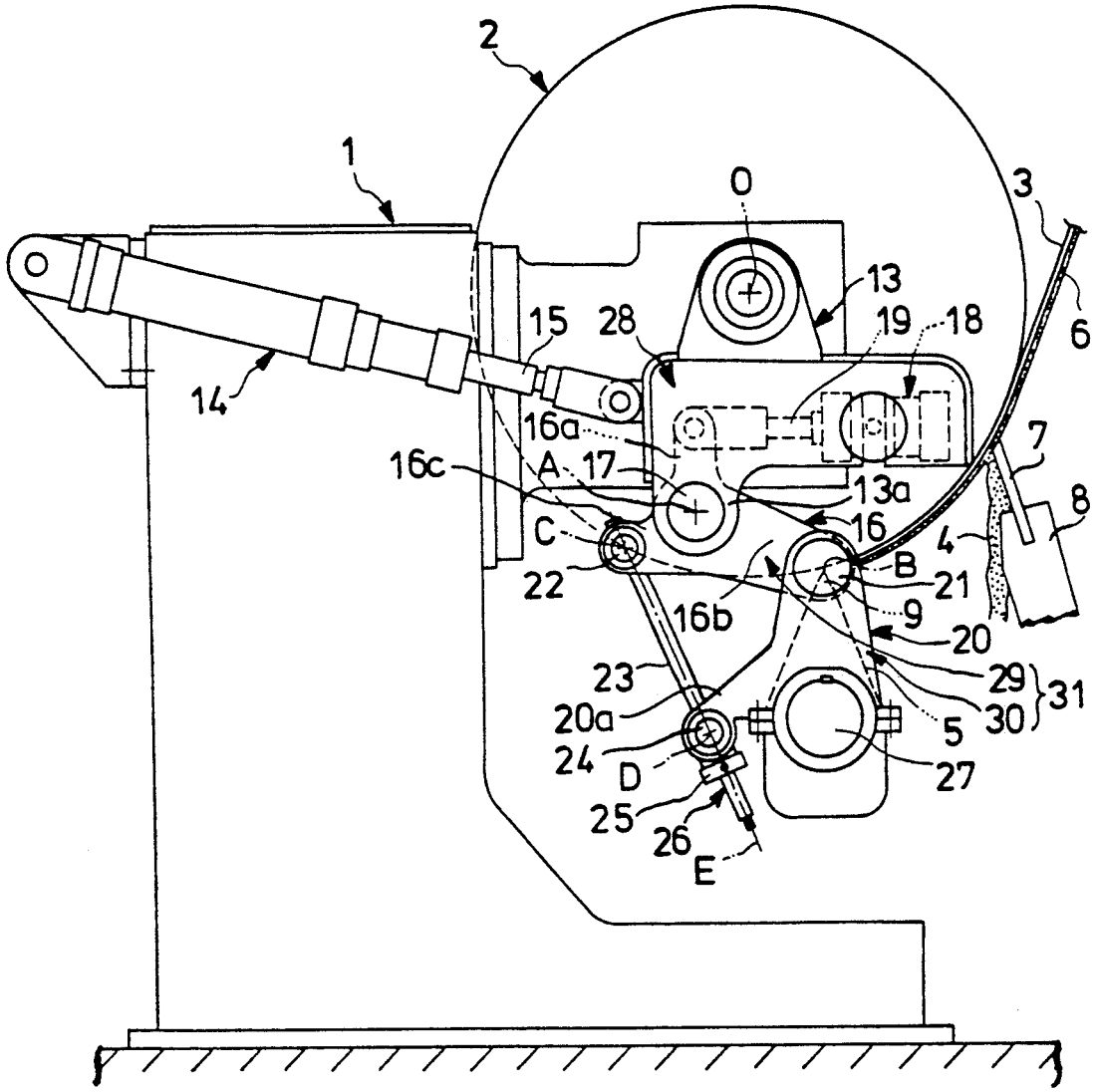

FIGS. 5(A) and 5(B) show a second embodiment of the present invention in which so-called dwell time can be changed as desired. The dwell time is a time period until excessive coating color 4 applied on the web 3 from the fountain 5 is removed by the measuring element 7. In the figures, the same reference numerals as in FIG. 2 refer to the same components.

A dwell time adjusting bracket 13 is mounted on the frame 1, which rotatably supports the backing roll 2, for its pivotal movement around an axis 0 of the roll 2. A drive 14 such as bearlocked cylinder having high positioning accuracy is pivotally mounted on the frame 1 with a rod 15 of the drive 14 being pivotally mounted at its tip on an end of the bracket 13. Thus, a dwell time adjusting mechanism 28 is provided so that stretching and contracting movement of the drive 14 can swing the bracket 13 around the axis 0.

The dwell time adjusting bracket 13 has a support arm 13*a* which is positioned adjacent to an outer periphery of the roll 2 and to which the gap adjusting bracket 16 is pivotally mounted through a pin 17 extending axially of the roll 2. A drive such as power cylinder 18 is mounted on the bracket 13 and has a rod 19 which is pivoted at its tip to a drive arm 16*a* of the gap adjusting bracket 16. Thus, a gap adjusting mechanism 29 is provided so that stretching and contracting movement of the drive 18 can swing the gap adjusting bracket 16 around the axis A of the pin 17.

The gap adjusting bracket 16 further has an operating arm 16*b* which extends to the outer periphery of the backing roll 2 and which has a tip to which in turn a fountain angle adjusting bracket 20 is pivoted through a pin 21 extending in parallel with the pin 17. The bracket 16 has a base arm 16*c* to which a screw shaft 23 is rotatably pivoted at its tip through a pin 22. The screw shaft 23 is further rotatably mounted at its intermediate portion to the fountain angle adjusting bracket 20 through a pin 24. Thus, the screw shaft 23 is rotatably and unremovably engaged with the base arm 16*c*, is rotatably engaged at the pin 24, which is rotatably mounted on the drive arm 20*a*, and is screwed with a nut 25, which is fixed to the drive arm 20*a*, thus providing a screw jack type drive 26 with the nut 25, whereby rotation of the shaft 23 around an axis E changes the gap between the base arm 16*c* and the drive arm 20*a*.

Further, the fountain 5 is mounted on the fountain angle adjusting bracket 20 such that its tip is approximately on the axis B of the pin 21 to provide a fountain angle adjusting mechanism 30. The fountain angle adjusting mechanism 30 and the gap adjusting mechanism 29 constitute the application adjusting mechanism 31 on the dwell time adjusting mechanism 28.

In FIGS. 5(A) and 5(B), C represents an axis of the pin 22 and D, an axis of the pin 24.

Next, description is given on the operation of the above embodiment.

When the rod 19 of the drive 18 is stretched or contracted, the gap adjusting bracket 16 and the fountain angle adjusting bracket 20 are integrally swung around the axis A of the pin 17 and the distance between the axes 0 and B is changed. That is, the gap t between the tip of the fountain 5 and the surface of the web 3 (See FIG. 4(A) or FIG. 4(B)) can be set to a desired value through actuation of the drive 18.

When the drive 26 is actuated in the form of rotating the screw shaft 23 by a motor or the like (not shown) in the condition as shown in FIG. 5(A) to change the relative position of the nut 25 to the shaft 23 as shown in FIG. 5(B), the fountain angle adjusting bracket 20 is swung around the axis B of the pin 21 relative to the gap adjusting bracket 16. As a result, the fountain angle $\theta$ (see FIG. 4(A) or 4(B)) can be set to a desired value without changing the above preset gap t.

Further, when the rod 15 of the drive 14 is stretched or contracted under the condition where the gap t and fountain angle $\theta$ are set to the values as desired, the dwell time adjusting bracket 13, the gap adjusting bracket 16 and the fountain angle adjusting bracket 20 are integrally swung around the axis 0 of the roll 2. With the distance between the axes 0 and B being maintained at a constant value, the fountain 5 moves closer to or away from the measuring element 7. Thus, the dwell time can be arbitrarily set while maintaining the gap t and the fountain angle $\theta$ at constant values.

Figure 4:
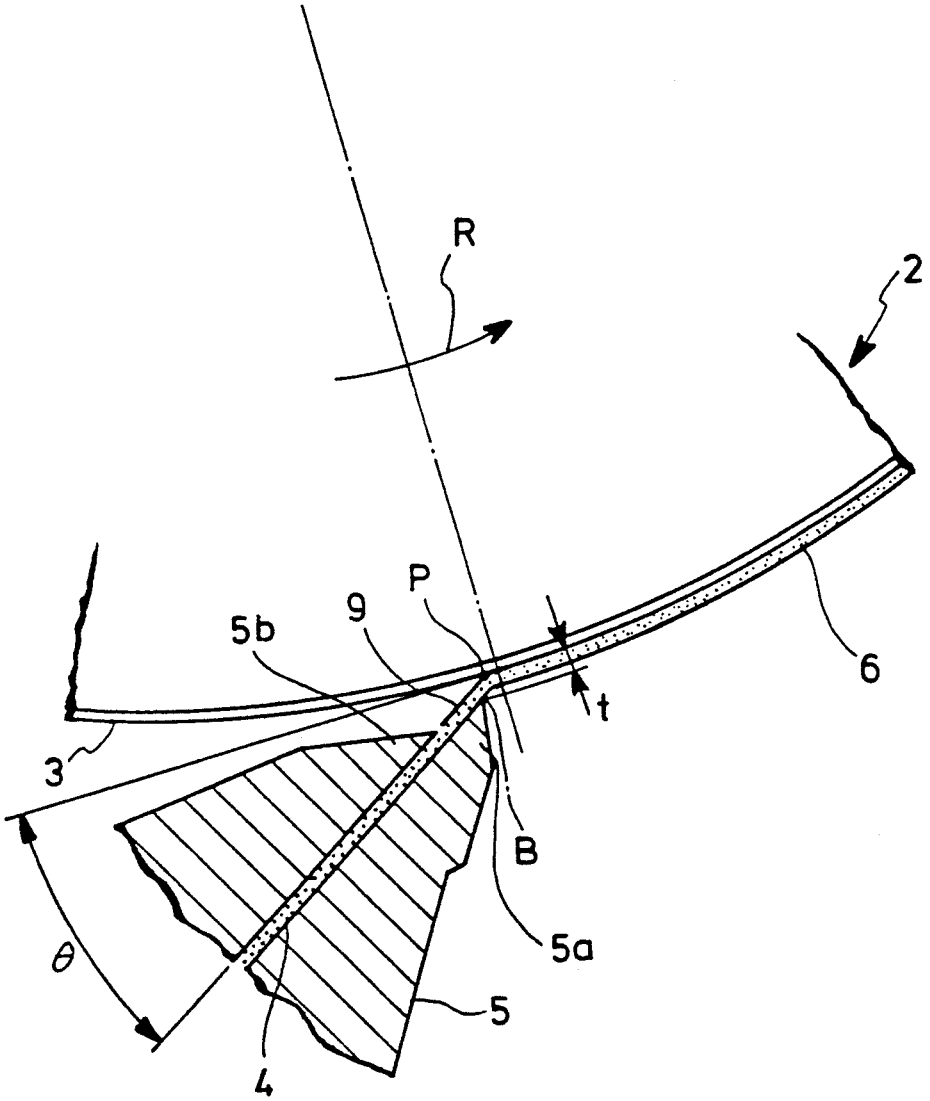
FIG. 4(A) is a partial enlarged view of some components used in the invention.
FIG. 4(B) is a view showing a modification of the fountain shown in FIG. 4(A)
Figure 4:
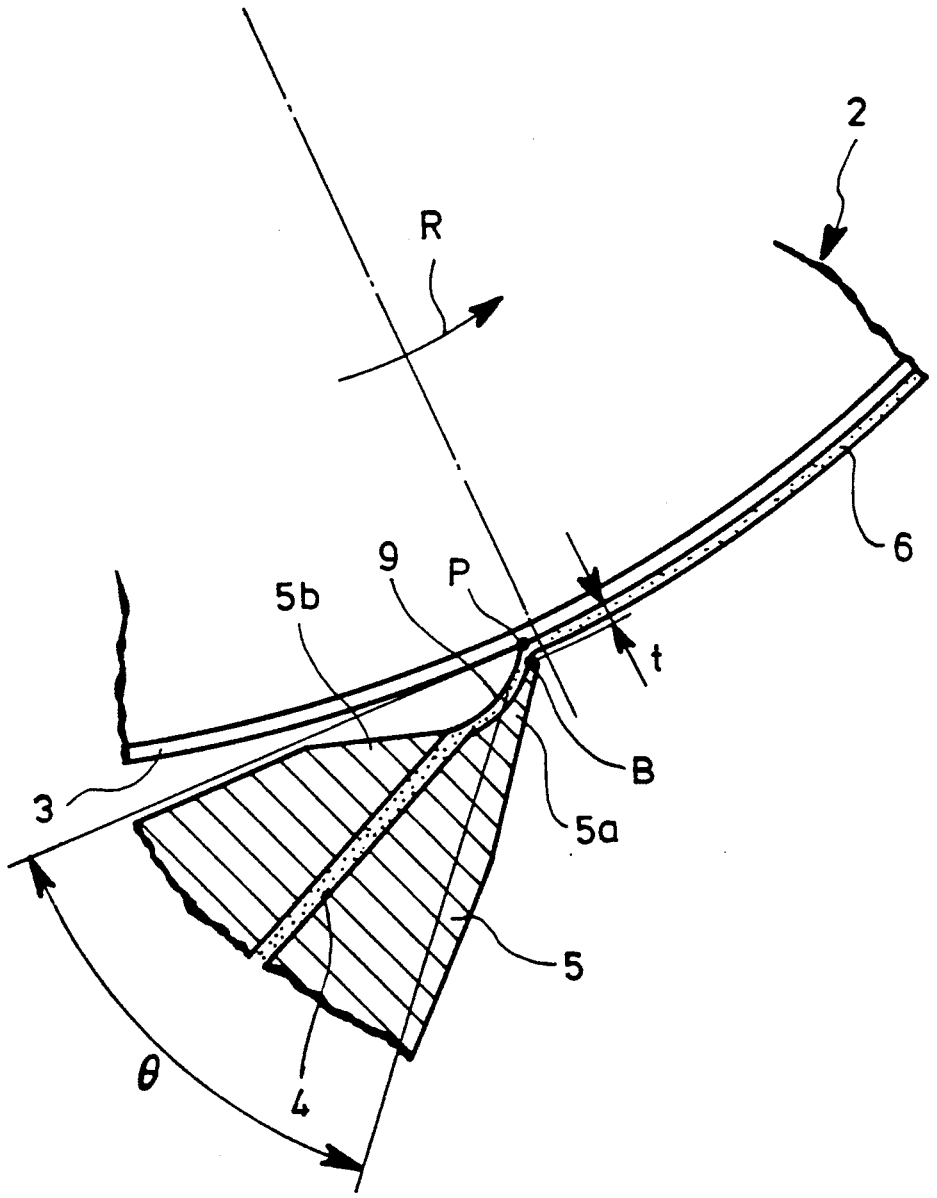

In the above two embodiments, the slit 9 of the fountain 5 may be defined by a pair of lips 5*a* and 5*b* of the fountain 5 such that, as shown in FIG. 4(A) or 4(B), the downstream lip 5*a* in the direction R of rotation of the roll 2 is longer than the upstream lip 5*b* and a tip of the downstream lip 5*a* is substantially on the swing axis B. This contributes to stabilization and uniformization of the application of the coating color 4. A modification shown in FIG. 4(B) in which the downstream lip 5*a* is concave for increase of the fountain angle $\theta$ is effective for prevention of interference between the fountain 5 and the metering element 7.

In this way, the applying condition of the coating color 4 to the web 3 can be easily controlled.

Generally in a fountain coater, the backing roll 2 must be replaced once in 1–2 months. In order to minimize a shutdown time, replacement operation of the roll 2 is to be effected quickly and in easier manner.

According to the second embodiment of the present invention, the swing axis of the dwell time adjusting bracket 13 is on the axis 0 of the backing roll 2 as described above so that there is no problem with an operating side of the roll 2 whereas at an drive side of the roll 2, because of the dwell time adjusting bracket 13 being suspended from and fixed to a cylindrical member concentrically surrounding an outer periphery of a drive journal of the backing roll 2, disadvantageously the drive journal will interfere with the cylindrical member when the roll 2 is removed for replacement. As a result, worryingly the cylindrical member must be removed temporarily.

Figure 6:
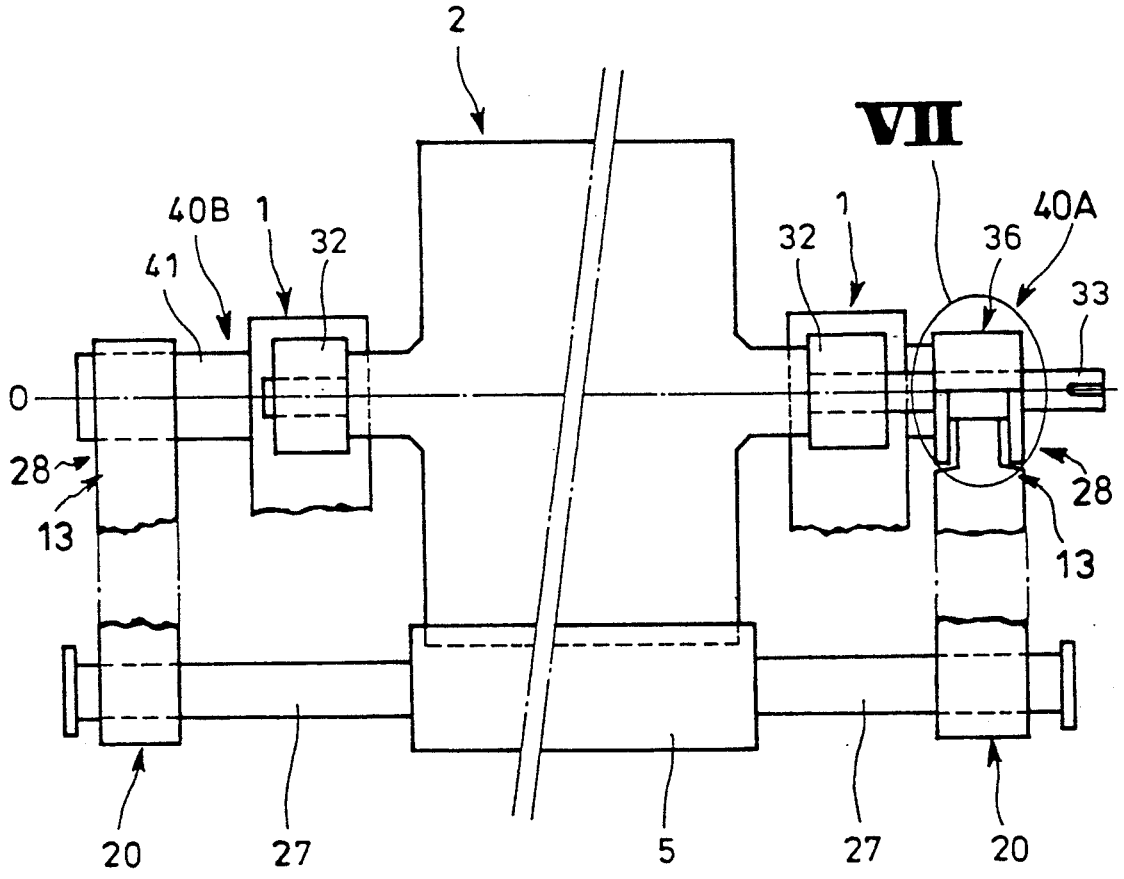
FIG. 6 is a front view showing an example of how to support a dwell time adjusting mechanism to be installed on a drive side of the backing roll in the second embodiment shown in FIGS. 5(A) and 5(B)
Figure 7:
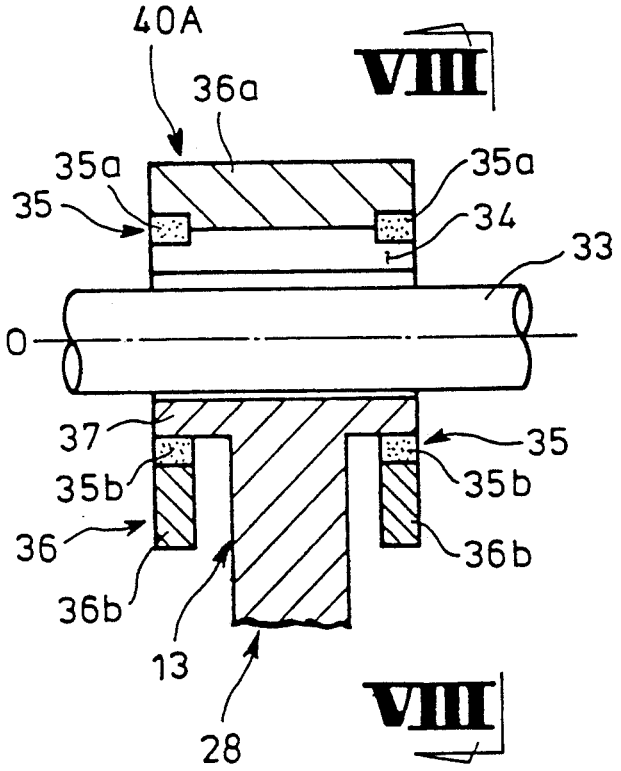
FIG. 7 is an enlarged sectional view of the portion VII in FIG. 6.
Figure 8:
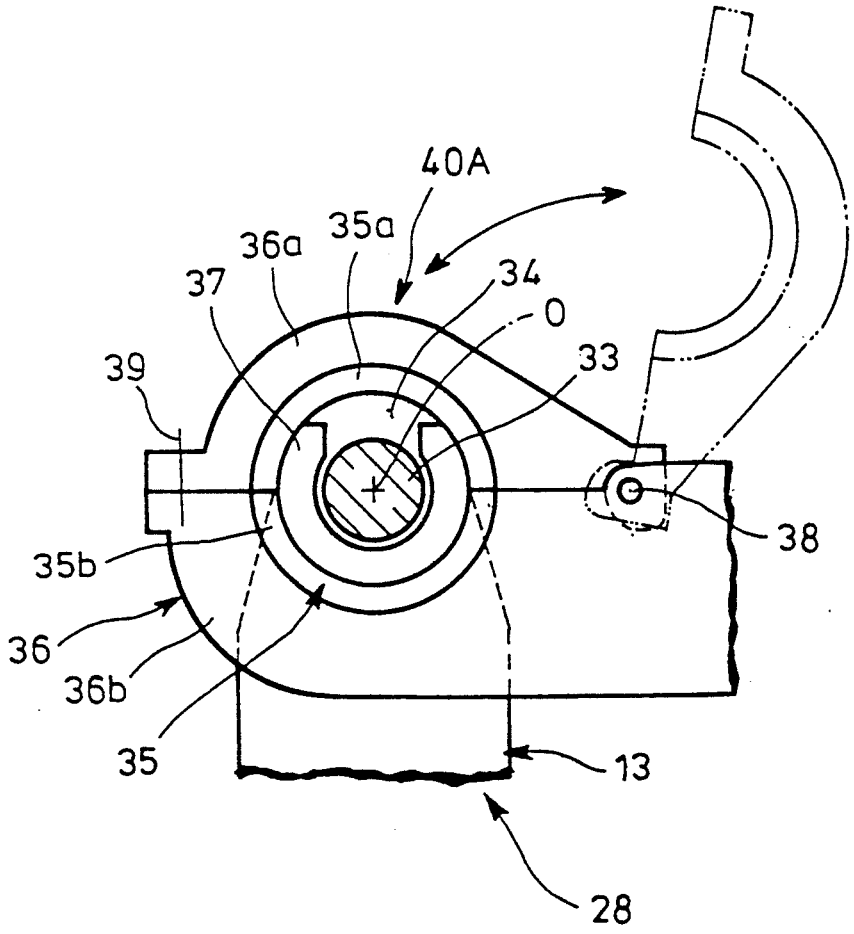
FIG. 8 is a view looking in the direction of the arrows VIII—VIII in FIG. 7.

FIGS. 6 to 8 show an example of a fountain coater having the fountain 5 pivotable around the axis 0 of the backing roll 2 which can overcome the above problem and the backing roll 2 can be replaced quickly and easily. In the figures, the same reference numerals as in FIGS. 5(A) and 5(B) refer to the same components.

As shown in FIG. 6, the backing roll 2 is supported on the main body frames 1 installed on the drive and operating sides through bearings 32. On the drive side of the roll 2, a drive journal 33 connected to a motor or the like extends on the axis 0 of the roll 2.

The dwell time adjusting brackets 13 on the drive and operating sides are swingably suspended from support shafts 40A and 40B mounted on the extension of the axis of the backing roll 2, respectively. The support shaft 40B on the operating side comprises a shaft member 41 fixed on the frame 1, the dwell time adjusting bracket 13 of the operating side being fitted over an outer periphery of the member 41 through a bearing or the like.

On the other hand, the support shaft 40A on the drive side is made up as follows:

As shown in FIGS. 7 and 8, bushes 35 and a bush-supporting frame 36 which together define an annular space 34 around the drive journal 33 of the backing roll 2 are respectively halved into upper and lower bush portions 35*a* and 35*b* and upper and lower support frame portions 36*a* and 36*b*. The lower support frame portion 36*b* is fixed to the frame 1 on the drive side of the roll 2 (see FIG. 6) so that the upper support frame portion 36*a* can be opened or closed in relation to the lower support frame portion 36*b*. The bush portions 35*a* and 35*b* together receive a slide member 37 having substantially U-shaped cross-section to which the dwell time adjusting bracket 13 of the dwell time adjusting mechanism 28 on the drive side of the backing roll 2 is suspendedly fixed.

The upper and lower bush portions 35*a* and 35*b* are fixed to the upper and lower support frame portions 36*a* and 36*b*, respectively, and the upper support frame portion 36*a* is pivotably mounted around a pin 38 (see FIG. 8) in relation to the lower support frame 36*b* and is fixable by a swing bolt 39.

With the arrangement as described above having the fountain 5 swingable around the axis 0 of the roll 2, the fountain 5 can be moved closer to or away from the measuring element 7 for change of dwell time (see FIG. 5) while maintaining a constant gap and a constant fountain angle and the applying condition of coating color 4 to the web 3 can be easily controlled. Upon replacement of the backing roll 2, the bolt 39 is loosened and the upper support frame portion 36*a* and the upper bush portion 35*a* are opened in relation to the lower support frame portion 36*b* and the lower bush portion 35*b* as shown by imaginary line in FIG. 8 so that the drive journal 33 can be pulled upward together with the backing roll 2 and the bearings 32 by a crane or the like for replacement of the roll 2 without removing the slide member 37 because the slide member 37 has substantially U-shaped cross-section and is opened upward.

As described above, the backing roll 2 can be replaced rapidly and easier and the shutdown time can be shortened.

What is claimed is:

1. In a fountain coater including a backing roll and a fountain for applying through a slit at a tip thereof a coating color on a surface of a web engaged with said backing roll for movement of said web, and a metering element at an outer periphery of the backing roll and downstream of the fountain for removing excessive coating color applied to form a uniform coating color layer on the web, the improvement comprising an application adjusting mechanism through which the fountain is pivotably supported at said tip thereof so as to be angularly displaceable around said tip, said application adjusting mechanism including a gap adjusting bracket swingable around an axis extending in parallel with an axis of the backing roll, a drive for swinging said gap adjusting bracket, said gap adjusting bracket having an operating arm extending to an outer periphery of the backing roll, a fountain angle adjusting bracket mounted on said operating arm so as to be swung around an axis in parallel with an axis of swing of said gap adjusting bracket, said fountain being supported by said fountain angle adjusting bracket with the tip of the fountain being substantially on said axis of swing of the fountain angle adjusting bracket, and a further drive between said gap adjusting bracket and said fountain angle adjusting bracket for swinging said fountain angle adjusting bracket.

2. The fountain coater according to claim 1 wherein the slit of the fountain is defined by a pair of lips such that one of the lips downstream in the direction of rotation of the roll is longer than the other lip and a tip of said downstream lip is substantially on an axis of swing of the fountain.

3. The fountain coater according to claim 1 or 2 wherein the application adjusting mechanism is installed on a dwell time adjusting mechanism which is pivotable around an axis of the backing roll.

4. The fountain coater according to claim 3 wherein said dwell time adjusting mechanism comprises a dwell time adjusting bracket pivotable around the axis of the backing roll and a drive between a main body frame for said backing roll and said dwell time adjusting bracket for swinging said dwell time adjusting bracket.

5. The fountain coater according to claim 4 wherein a drive journal for the backing roll is surrounded by a bush to define an annular space, said bush being supported by a support frame, said bush and support frame being respectively halved into upper and lower bush portions and upper and lower support frame portions, said lower support frame portion being fixed to the main body frame on a drive side of the backing roll, said upper support frame portion being openable and closable in relation to said lower support frame portion, a slide member of substantially U-shaped section being received in said bush for sliding movement thereof, the dwell time adjusting bracket of the dwell time adjusting mechanism on the drive side of the backing roll being suspendedly fixed to a lower portion of said slide member.

* * * * *